US006527202B1

(12) United States Patent
Tseng

(10) Patent No.: US 6,527,202 B1
(45) Date of Patent: Mar. 4, 2003

(54) COMPRESSION STRUCTURE OF A SPRAY GUN

(75) Inventor: Kun-Lung Tseng, Taichung Hsien (TW)

(73) Assignee: Living Fountain Plastic Industrial Co., Ltd., Taichung (TW)

( * ) Notice: Subject to any disclaimer, the term of this patent is extended or adjusted under 35 U.S.C. 154(b) by 0 days.

(21) Appl. No.: 10/133,531

(22) Filed: Apr. 29, 2002

(51) Int. Cl.[7] ..... A62C 11/00

(52) U.S. Cl. ..... 239/333; 239/571; 222/207; 222/209; 222/214

(58) Field of Search ..... 239/333, 571; 222/383.1, 207, 214, 215, 209

(56) References Cited

U.S. PATENT DOCUMENTS 3,973,700 A * 8/1976 Schmidt et al. ..... 222/207
4,225,061 A * 9/1980 Blake et al. ..... 222/207
4,260,079 A * 4/1981 Cary et al. ..... 222/214
5,114,052 A * 5/1992 Tiramani et al. ..... 222/207
5,439,178 A * 8/1995 Peterson ..... 239/333

* cited by examiner

*Primary Examiner*—Michael Mar
*Assistant Examiner*—Dinh Q. Nguyen
(74) *Attorney, Agent, or Firm*—Harrison & Egbert

(57) ABSTRACT

A spray gun includes a main body which is provided in the interior with an upright tube, a guide tube, and a compression structure by which a fluid contained in a container is dispersed in the form of a spray via a spray head. The compression structure includes a compression tube located in the interior of the main body, and an elastic tube compressibly received in the compression tube such that the elastic tube is compressed by a connection rod which is actuated by a trigger lever pivoted at one end to the main body.

1 Claim, 8 Drawing Sheets

COMPRESSION STRUCTURE OF A SPRAY GUN

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a spray gun more particularly to a compression structure of the spray gun.

BACKGROUND OF THE INVENTION

As shown in FIGS. 1 and 2, a spray gun of the prior art comprise a main body 10 which is provided in the interior with a guide tube 11, an upright tube 12, and a compression tube 13. The guide tube 11 is connected at the front end with a discharge tube 14 which is connected with a spray head 15. The guide tube 11 is in communication with the upright tube 12 via a through hole 16. Located between the front end of the interior of the guide tube 11 and the discharge tube 14 is a stop pin 18, which is urged by a C-shaped elastic piece 17. The compression tube 13 is provided at the inner end with a through hole 29 in communication with the upright tube 12. A piston 30 is received in the outer end of the compression tube 13 in conjunction with a metal spring 31. A trigger lever 32 is fastened pivotally with the main body 10 such that the trigger lever 32 is contiguous to the spray head 15, and that the trigger lever 32 presses against a rod portion 33 of the piston 30. As the trigger lever 32 is activated to actuate the piston 30, the pressure is built up in the compression tube 13. As a result, the spray head 15 disperses the contents of a container in the form of a spray by the air pressure in the compression tube 13 which serves as a compressor.

With the exception of the metal spring 31, all component parts of the prior art spray gun are made of a plastic material, which is recyclable. It is time-consuming to remove the metal spring 31 from a discarded spray gun in the recycling process. In addition, the prior art spray gun is defective in design in that the rod portion 33 of the piston 30 is apt to sway at the time when it is pressed against by the trigger lever 32, thereby resulting in poor performance of the spray gun.

BRIEF SUMMARY OF THE INVENTION

The primary objective of the present invention is to provide a spray gun with a compression structure devoid of a metal spring, so as to facilitate the recycling of the spray gun.

In keeping with the principle of the present invention, the foregoing objective of the present invention is attained by the compression structure comprising a compression tube which is in communication with an upright tube which is in turn in communication with a guide tube. The guide tube is in communication with a spray head. The compression tube is provided with an elastic tube fitted thereinto. The elastic tube has a closed outer end. A connection rod is connected at an inner end with the outer end of the elastic tube such that an outer end of the connection rod is pivoted with a trigger lever. The elastic tube serves as a piston, which is actuated by the trigger lever via the connection rod to compress fluid, thereby enabling the spray head to disperse the contents of a container in the form of a spray by the fluid pressure.

The features and the advantages of the present invention will be more readily understood upon a thoughtful deliberation of the following detailed description of the present invention with reference to the accompanying drawings.

DETAILED DESCRIPTION OF THE INVENTION

Figure 1:
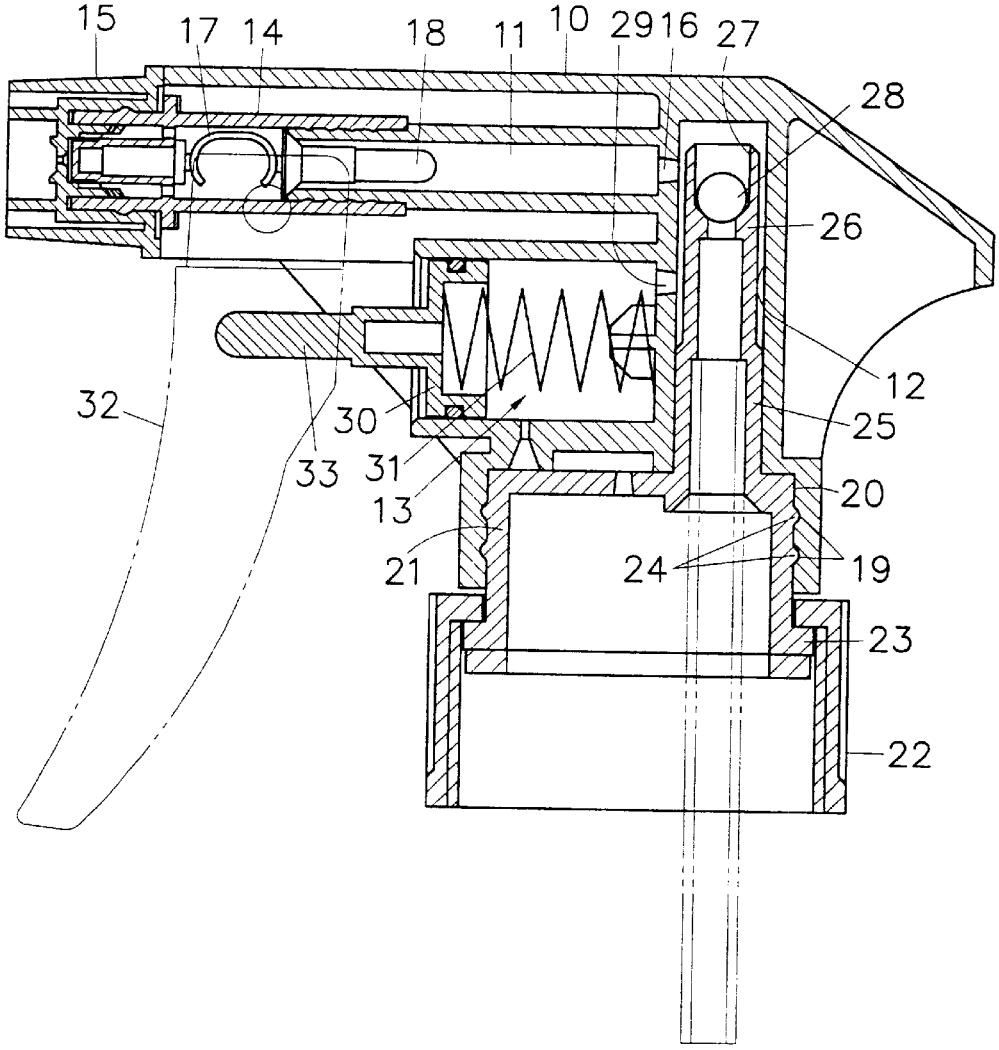
FIG.1 PRIOR ART
FIG. 1 shows a sectional schematic view of a prior art spray gun.
Figure 2:
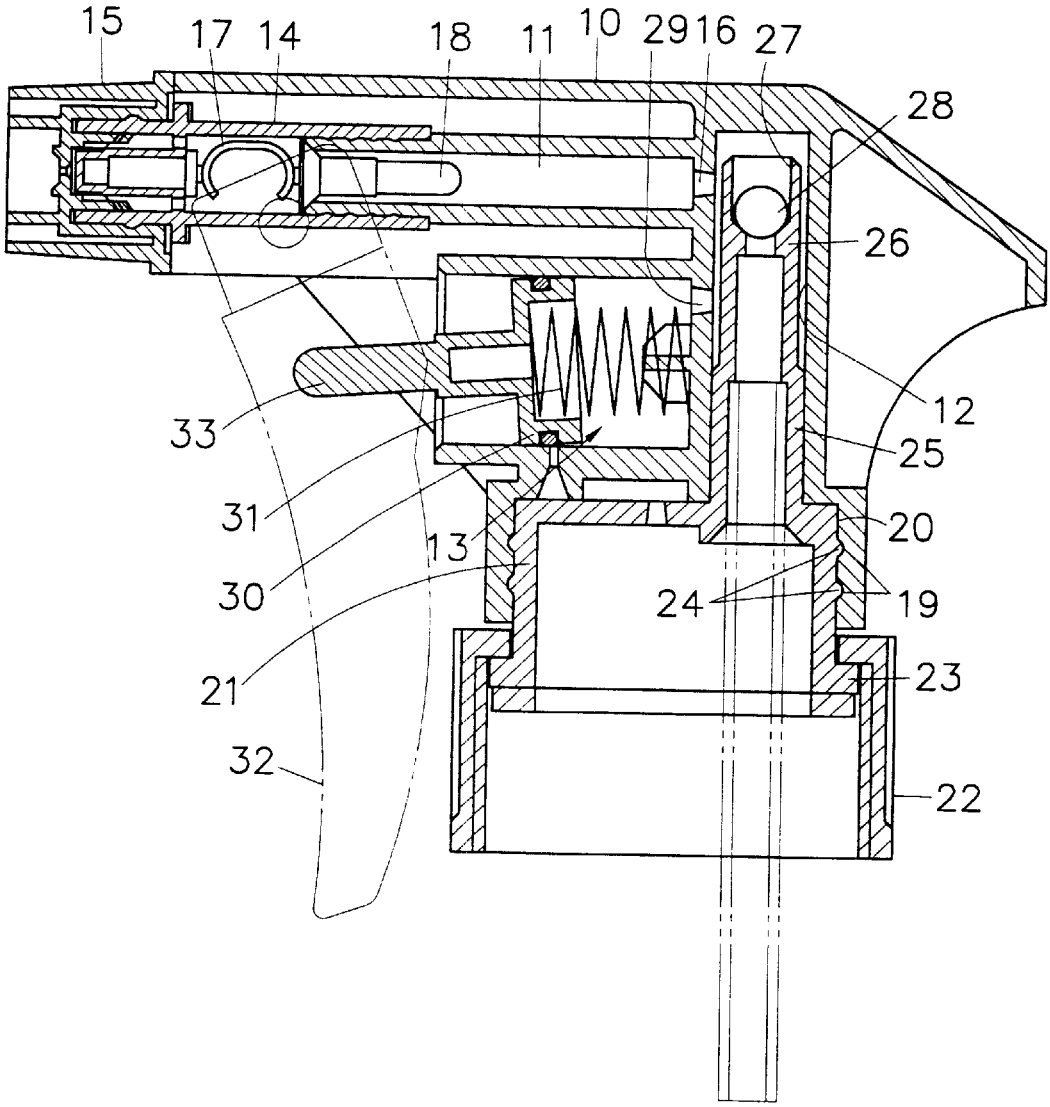
FIG. 2 PRIOR ART
FIG. 2 shows a sectional schematic view of the prior art spray in action.
Figure 3:
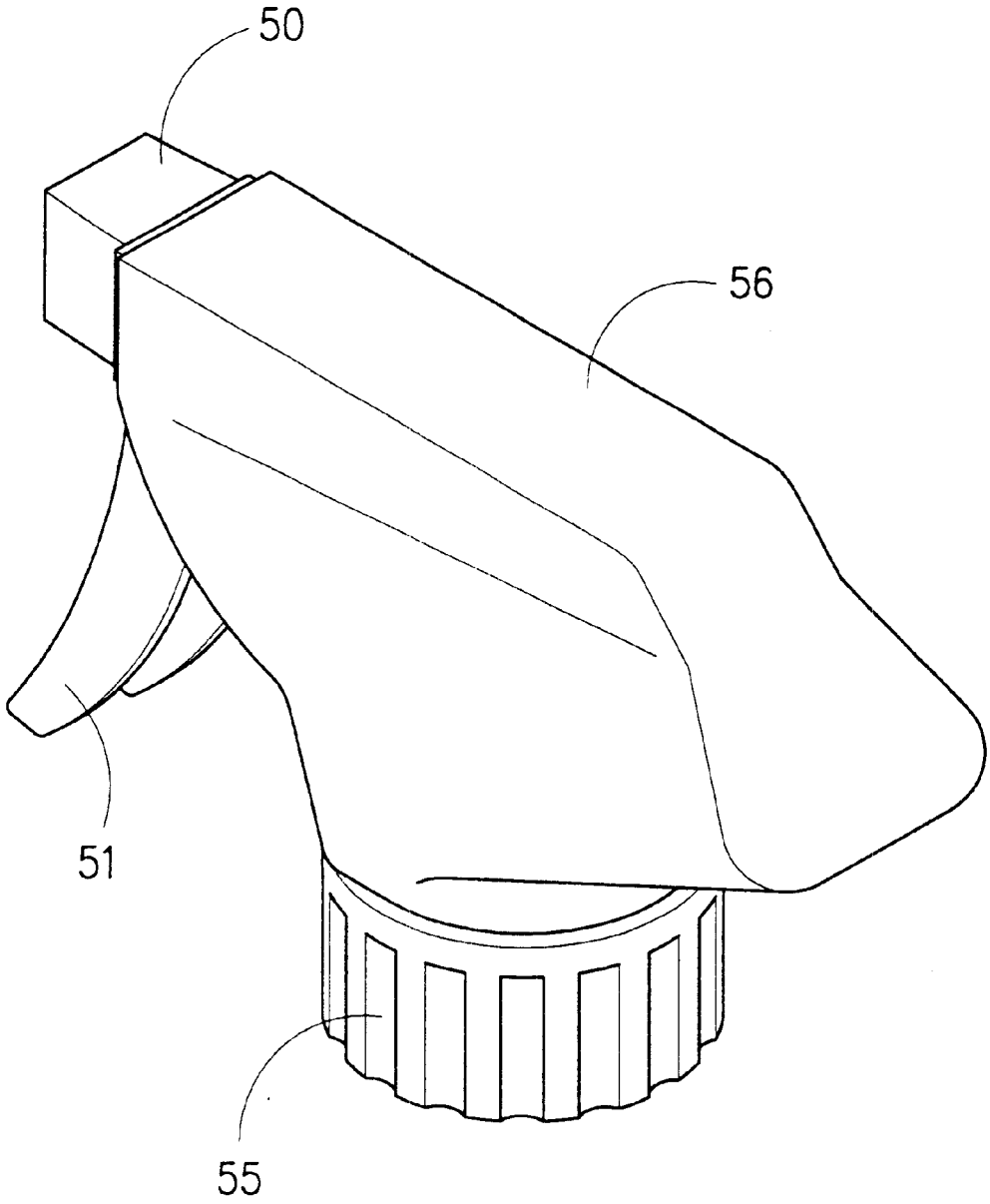
FIG. 3 shows a perspective view of a spray gun of the present invention.
Figure 4:
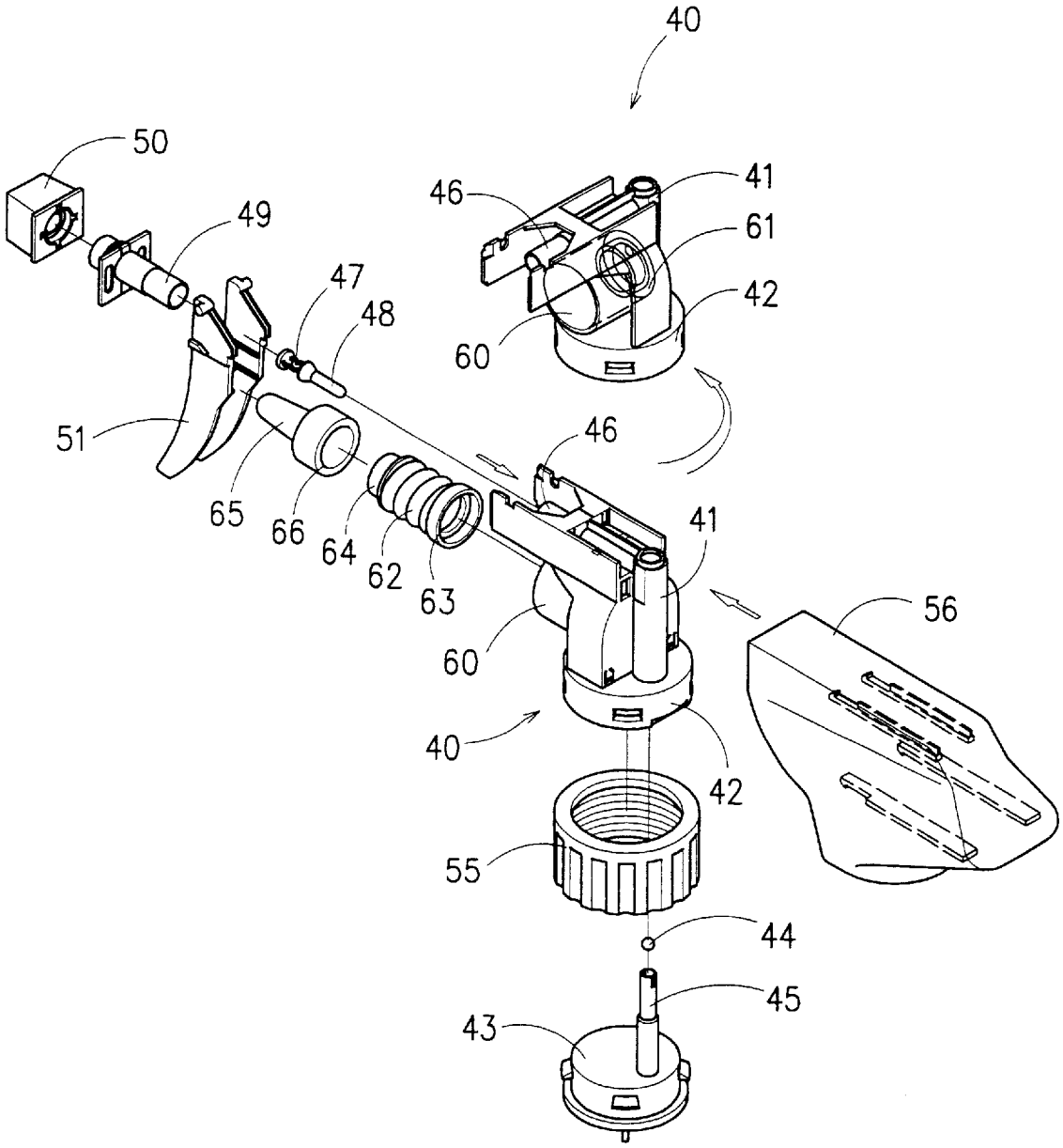
FIG. 4 shows an exploded perspective view of the spray gun of the present invention.
Figure 5:
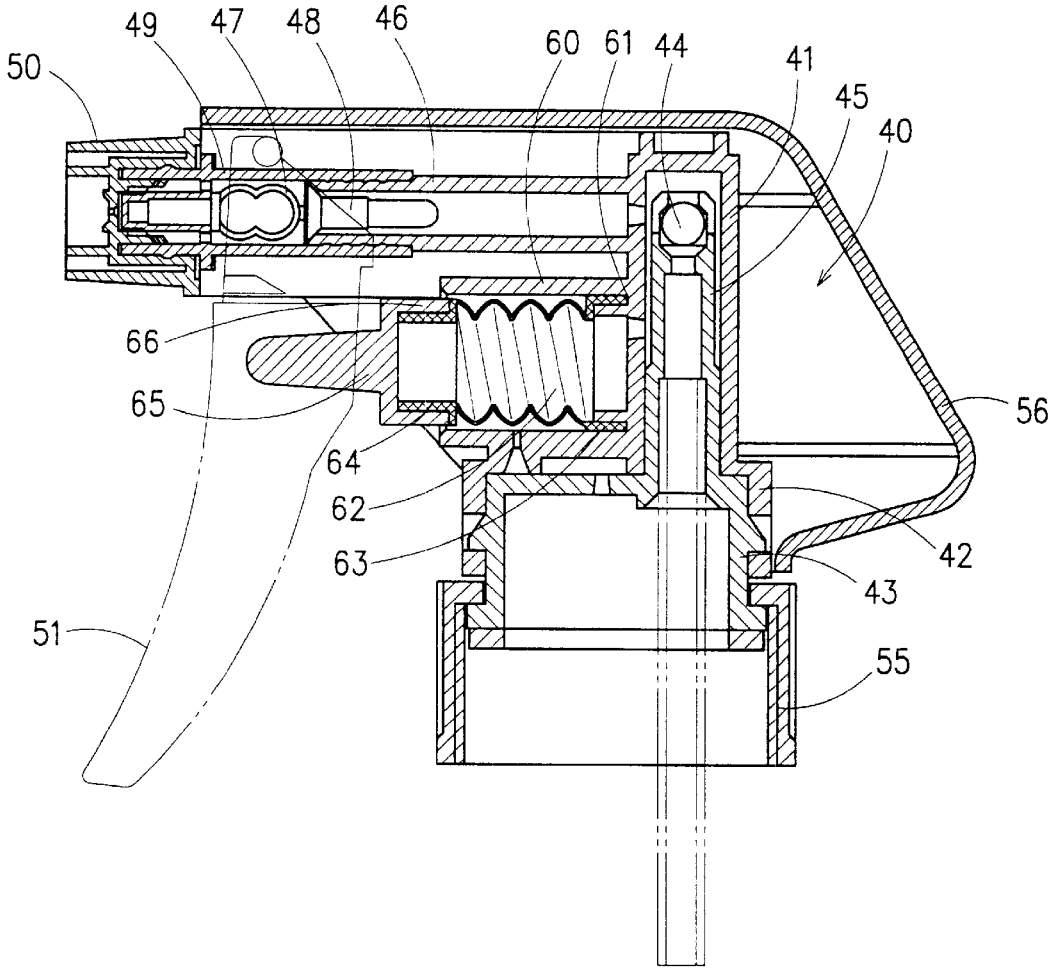
FIG. 5 shows a sectional view of the spray gun of the present invention.
Figure 6:
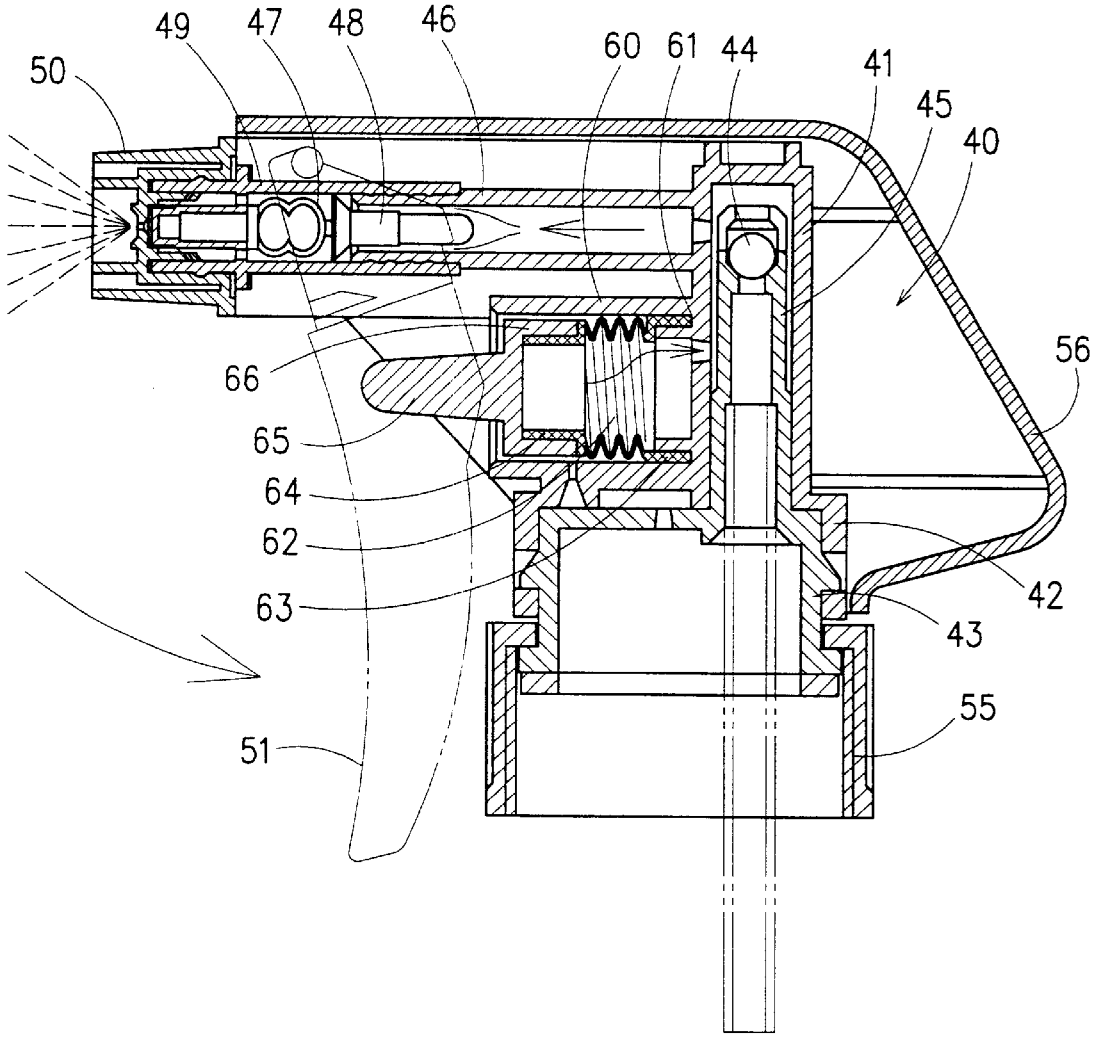
FIG. 6 shows a sectional schematic view of the spray gun of the present invention in action.

As shown in FIGS. 3–7, a spray gun of the present invention comprises a main body 40, a spray head 50, a trigger lever 51, a container connector 55, and a shield 56.

The main body 40 comprises an upright tube 41, a base 42, and a guide tube 46. The base 42 is provided with an inner end 43 and an inner tube 45. The inner tube 45 and the upright tube 41 form a first check device in conjunction with a check ball 44. The base 42 is fastened to the container connector 55 by which the spray gun is fastened to a container.

The spray head 50 is in communication with the guide tube 46 of the main body 40 via a discharge tube 49 in conjunction with a check pin 48 having an elastic arm 47. The discharge tube 49 and the check pin 48 form a second check device. The spray head 50 is fastened to the discharge tube 49.

The main body 40 is further provided with a compression structure which is connected with the trigger lever 51. The compression structure comprises a compression tube 60, which is in communication with the upright tube 41, an elastic tube 62 received in the compression tube 60, and a connection rod 65 connected with the elastic tube 62 and the trigger lever 51. The compression tube 60 is provided in an inner end with a retaining groove 61. The elastic tube 62 is provided at an open inner end with a retaining edge 63. The elastic tube 62 is compressibly received in the compression tube 60 such that the retaining edge 63 of the open inner end of the elastic tube 62 is retained in the retaining groove 61 of the inner end of the compression tube 60. The elastic tube 62 has a closed outer end 64.

The connection rod 65 has a connection end 66, which is fitted over the closed outer end 64 of the elastic tube 62. The connection rod 65 is fastened at an outer end with the trigger lever 51.

Figure 7:
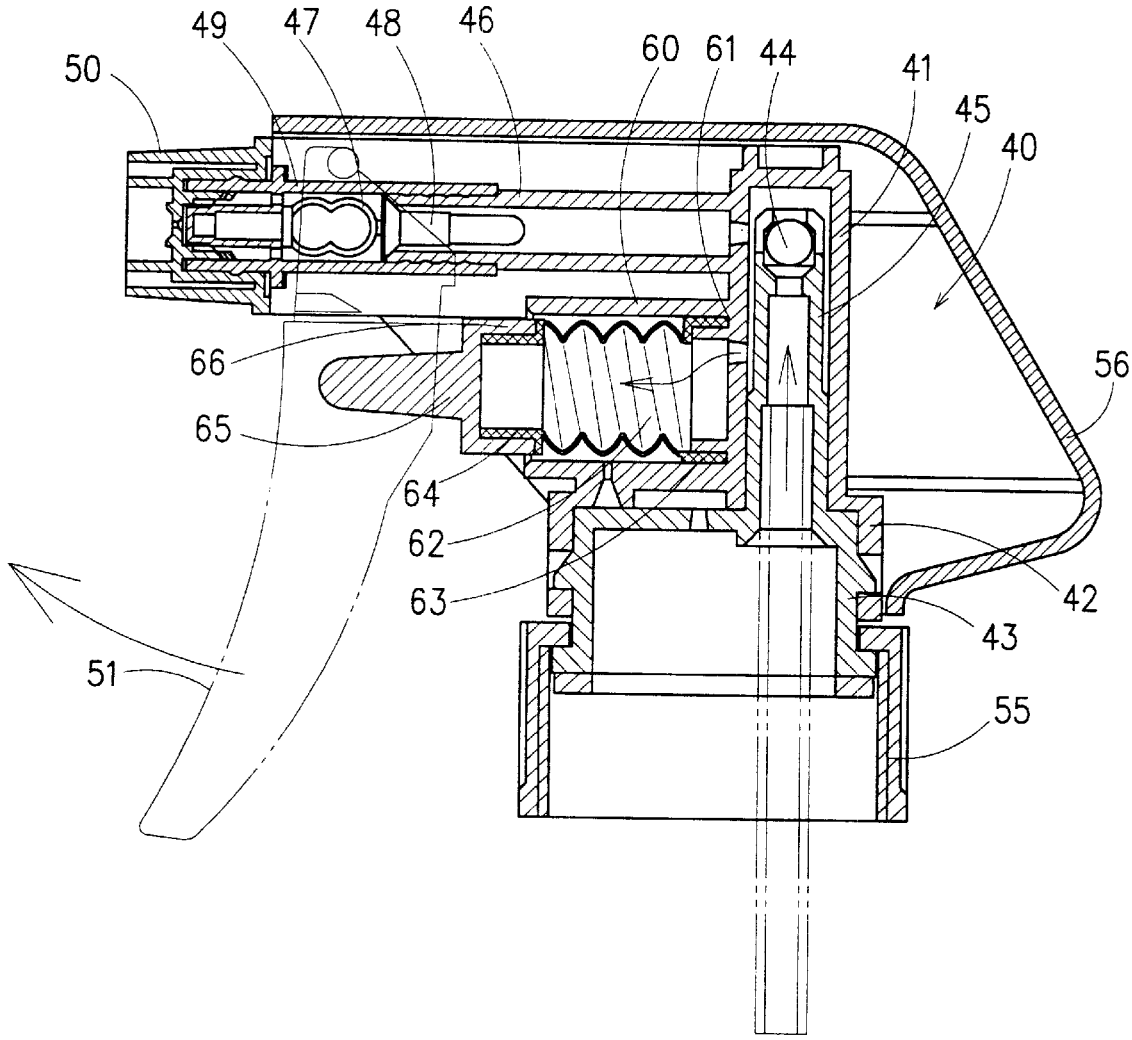
FIG. 7 shows another sectional schematic view of the spray gun of the present invention in action.
Figure 8:
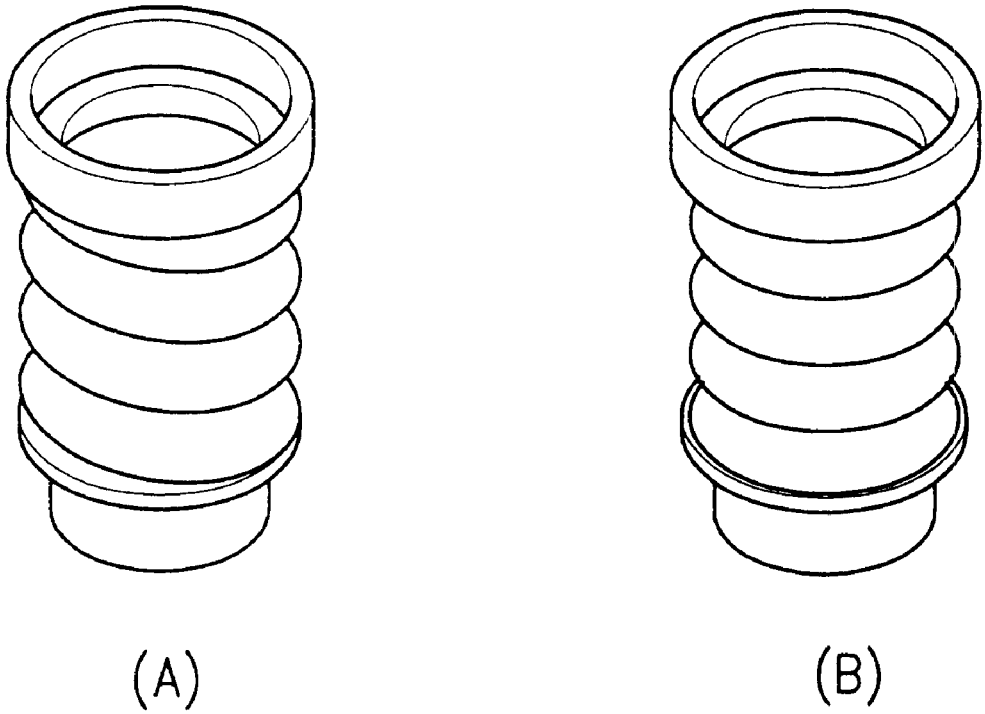
FIG. 8 shows a perspective view of an elastic tube of the present invention at work .

In operation, the trigger lever 51 is activated by an external force such that the connection rod 65 is actuated to compress the elastic tube 62, thereby resulting in compression of a fluid which is contained in the elastic tube 62. The fluid of a container is thus dispersed in the form of a spray by the spray head 50 via the upright tube 41, the guide tube 46, and the discharge tube 49. As soon as the trigger lever 51 is relieved of the external force, the deformed elastic tube 62 springs back to its original shape. As a result, the fluid is drawn into the elastic tube 62 by suction via the first check device and the upright tube 41, as shown in FIG. 7.

All component parts of the spray gun of the present invention are made of a plastic material so as to facilitate the recycling of the spray gun of the present invention.

The elastic tube 62 of the spray gun of the present invention serves as an elastic element and a piston.

I claim:

1. A spray gun comprising:

a container connector for connecting the spray gun with a container in which a fluid is held;

a main body fastened at one end to said container connector and comprised of, in an interior, an upright tube, a guide tube, a discharge tube, and a compression structure, said upright tube being in communication with the container, said compression structure, said guide tube, and said discharge tube;

a spray head fastened to said discharge tube for dispersing the fluid of the container in the form of a spray; and a trigger lever pivoted at one end with said main body such that said trigger lever is connected with said compression structure of said main body whereby said trigger lever is activated by an external force to actuate said compression structure, so as to enable said spray head to disperse the fluid of the container;

wherein said compression structure comprises:

a compression tube located in the interior of said main body such that said compression tube is in communication with said upright tube via an inner end of said compression tube whereby said inner end is comprised of, in an inner wall thereof, a retaining groove;

an elastic tube provided at an open inner end with a retaining edge, said elastic tube being compressibly received in said compression tube such that said retaining edge of said elastic tube is retained in said retaining groove of said inner end of said compression tube, said elastic tube further comprised of a closed outer end; and a connection rod fastened at an outer end to said trigger lever, and at an inner end to said closed outer end of said elastic tube whereby said connection rod is actuated by said trigger lever to compress said elastic tube at the time when said trigger lever is exerted on by an external force.

* * * * *